US006658770B2

(12) United States Patent
Heiple

(10) Patent No.: US 6,658,770 B2
(45) Date of Patent: Dec. 9, 2003

(54) IMPLEMENT COUPLING ASSEMBLY FOR EXCAVATING MACHINES AND THE LIKE

(75) Inventor: Ashley Heiple, Alum Bank, PA (US)

(73) Assignee: Rockland, Inc., Bedford, PA (US)

( * ) Notice: Subject to any disclaimer, the term of this patent is extended or adjusted under 35 U.S.C. 154(b) by 154 days.

(21) Appl. No.: 10/046,010

(22) Filed: Jan. 11, 2002

(65) Prior Publication Data

US 2003/0131505 A1 Jul. 17, 2003

(51) Int. Cl.[7] ..... E02F 3/36
(52) U.S. Cl. ..... 37/468; 414/723
(58) Field of Search ..... 37/403, 468, 466, 37/443; 172/272, 273, 274; 403/322.1, 322.3, 15, 321; 414/723, 724, 680, 685

(56) References Cited

U.S. PATENT DOCUMENTS 5,024,010 A * 6/1991 Hulden ..... 37/417
5,431,528 A * 7/1995 Jenkins et al. ..... 414/723
5,581,917 A * 12/1996 Barden ..... 37/468
5,597,283 A * 1/1997 Jones ..... 414/723
5,890,871 A * 4/1999 Woerman ..... 414/723
6,202,331 B1 * 3/2001 Kobayashi ..... 37/403
6,241,455 B1 * 6/2001 Schupback et al. ..... 414/723
6,487,800 B1 * 12/2002 Evans et al. ..... 37/468

* cited by examiner

*Primary Examiner*—Robert E. Pezzuto
(74) *Attorney, Agent, or Firm*—Stevens, Davis, Miller & Mosher, LLP

(57) ABSTRACT

An assembly mountable on a dipper stick operatively connected to a machine, having a fluid actuated assembly, and connectable to an implement having at least one pair of opposed, connecting pin receiving recesses generally consisting of at least one spacer link including a pair of segments pivotally connected together and angularly displaceable relative to each other between retracted, inoperable and extended, operable positions, one of the link segments having a pin portion connectable to the dipper stick for pivotal open about its axis and receivable in one of the implement recesses and the other of the link segments having a pin portion operatively connectable to the fluid actuating assembly for pivotal movement about its axis and receivable in the other of the implement recesses, and a latch mounted thereon and cooperable with the one link segment when the segments are disposed in their extended, operative positions for releasably securing the link segments in their extended, operative positions.

24 Claims, 4 Drawing Sheets

IMPLEMENT COUPLING ASSEMBLY FOR EXCAVATING MACHINES AND THE LIKE

This invention relates to excavating machines and the like, and more particularly to an assembly for detachably coupling an implement to a dipper stick of such machines.

BACKGROUND OF THE INVENTION

In the construction, mining and other industries, it is highly desirable to readily couple and uncouple different implements such as buckets, grapples, rakes and the like relative to the dipper stick of such machines in order to enhance productivity. Preferably, the assemblies for readily coupling and uncoupling such implements should be simple in design to minimize manufacturing costs, easy to mount on conventional dipper sticks and readily operable to quickly and reliably couple and uncouple the implement onto and off of a dipper stick.

In view of the foregoing, the principal object of the present invention is to provide an assembly for detachably coupling an implement to the dipper stick of a machine, which meets such criteria of design, installation and use.

SUMMARY OF THE INVENTION

The present invention meets the requirements of the aforementioned criteria by providing an assembly mountable on a dipper stick and a fluid actuated assembly of a machine, and connectable to an implement having at least one pair of opposed, connecting pin receiving recesses, generally comprising at least one spacer link including a pair of segments pivotally connected together and angularly displaceable relative to each other between retracted, inoperable and extended, operable positions, one of such a link segments having a pin portion connectable to the dipper stick for pivotal movement about its axis and receivable in one of the implement recesses, and the other of the link segments having a pin portion operatively connectable to the fluid actuated assembly for pivotal movement about its axis and receivable in the other of the implement recesses, and means mounted thereon and cooperable with the one link segment when the link segments are disposed in their extended, operatively positions for releasably securing the link segments in their extended, operative positions. Preferably the assembly includes a pair of such links, each disposed on a side of the dipper stick. In addition, the releasably securing means comprises a latch on one of the link segments, cooperable with the other link segment when the link segments are in their extended, operative positions, for preventing the link segments from displacing from their extended, operative positions to their retracted, inoperable positions. In one embodiment, the latch may comprise a toggle bolt pivotally connected to one of the main link segments and receivable within a recess of the other link segment to releasably secure the segments together. In another embodiment of the invention, such a latch may comprise a spring biased pin mounted in one of the link segments and receivable in a registrable opening in the other link segment when the link segments are disposed in their extended, operable positions, with a pin disposed in such opening in the other link segment which may be displaced to eject such spring biased pin from the opening in the other link segment to permit the link segments to pivot from their extended, operative positions to their retracted, inoperable positions.

DETAILED DESCRIPTION OF THE PREFERRED EMBODIMENTS OF THE INVENTION

Figure 2:
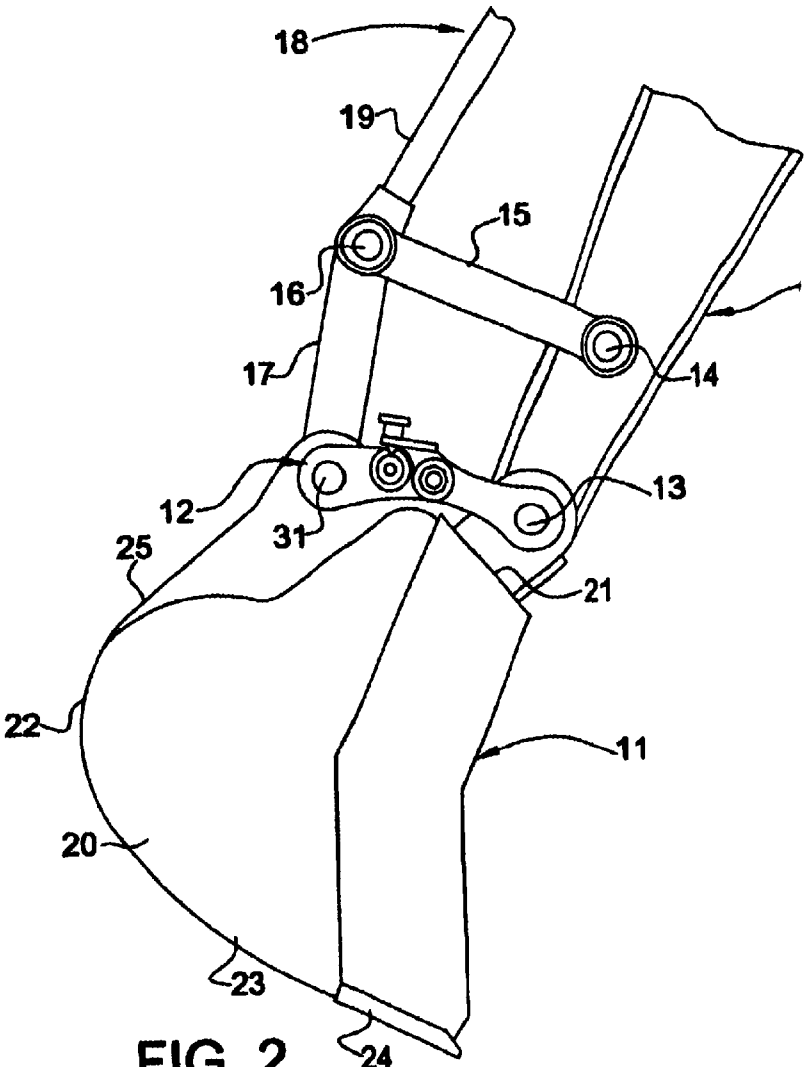
FIG. 2 is a view similar to the view shown in FIG. 1, illustrating the coupling assembly in its expanded, operative condition.
Figure 1:
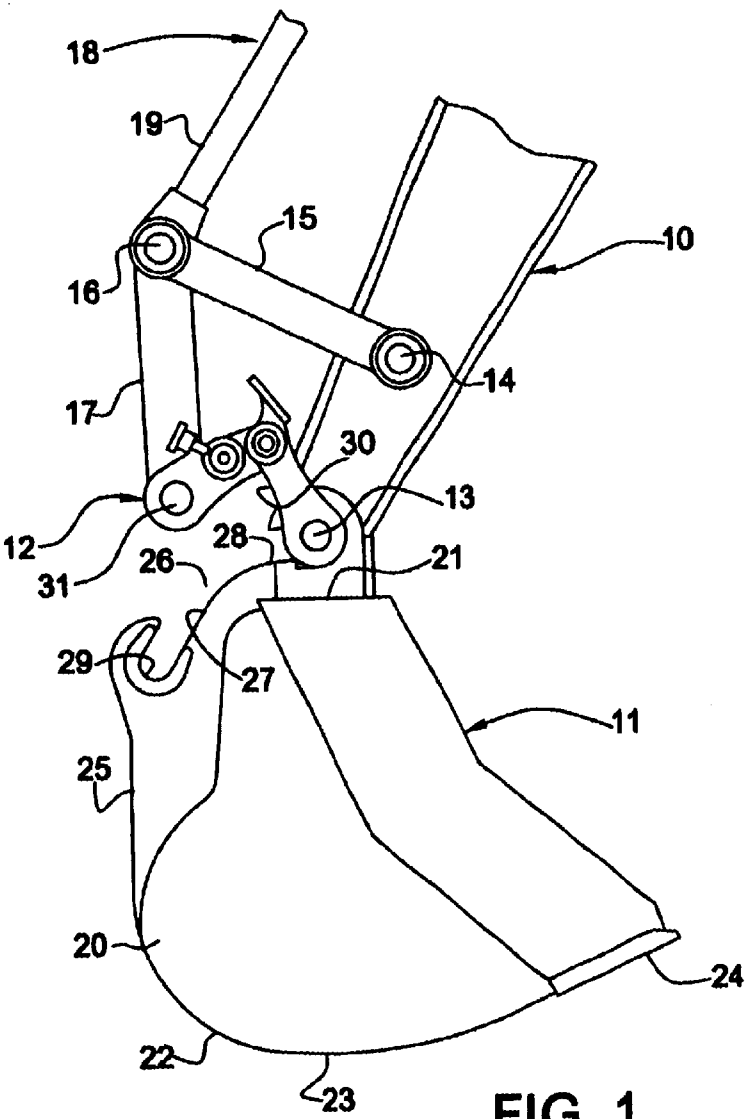
FIG. 1 is a side elevational view of an embodiment of the invention illustrating the coupling assembly thereof in a collapsed, inoperative condition.

Referring to FIGS. 1 and 2 of the drawings, there is illustrated a dipper stick 10 of a excavating machine, an implement in the form of an excavating bucket 11 and an assembly 12 for coupling the implement to the free end of the dipper stick in the conventional manner. Dipper stick 10 is of a conventional construction and is pivotally connected at an upper end thereof to a boom, and is pivotal relative to such boom by means of a fluid actuated cylinder assembly. Rotatably mounted on the free end of dipper stick 10 is a first connecting pin 13 having a transversely disposed axis. Spaced from pin 13 is a mounting pin 14 having a transverse axis on which a pair of support links 15, 15 are mounted for pivotal movement in parallel planes, relative to the dipper stick. The free ends of the support links are pivotally connected to a connecting pin 16 on which there also are pivotally connected the upper ends of a pair of actuating links 17, 17. Operatively interconnecting the under side of the dipper stick and connecting pin 16 is a fluid actuated assembly 18 including a cylinder member having the base end thereof pivotally connected to a set of brackets mounted on the underside of the dipper, and a rod member 19 pivotally connected at its free end to connecting pin 16.

Bucket 11 is of a conventional configuration except for the mounting brackets. It is provided with a pair of laterally spaced sidewalls 20, 20 an adjoining wall including an upper wall section 21, a downwardly and forwardly curved, rear wall section 22 and a forwardly extending bottom wall section 23 terminating at a front cutting edge 24. Rigidly secured to the upper wall section 21 and rear wall section 22 is a pair of identical, laterally spaced mounting brackets 25, 25. As best seen in FIG. 1, each of the brackets is recessed in an upper edge thereof, as at 26, providing an entry or access passageway and a pair of lower guide surfaces 27 and 28 inclined toward a pair of opposed pin receiving recess portions 29 and 30.

Figure 3:
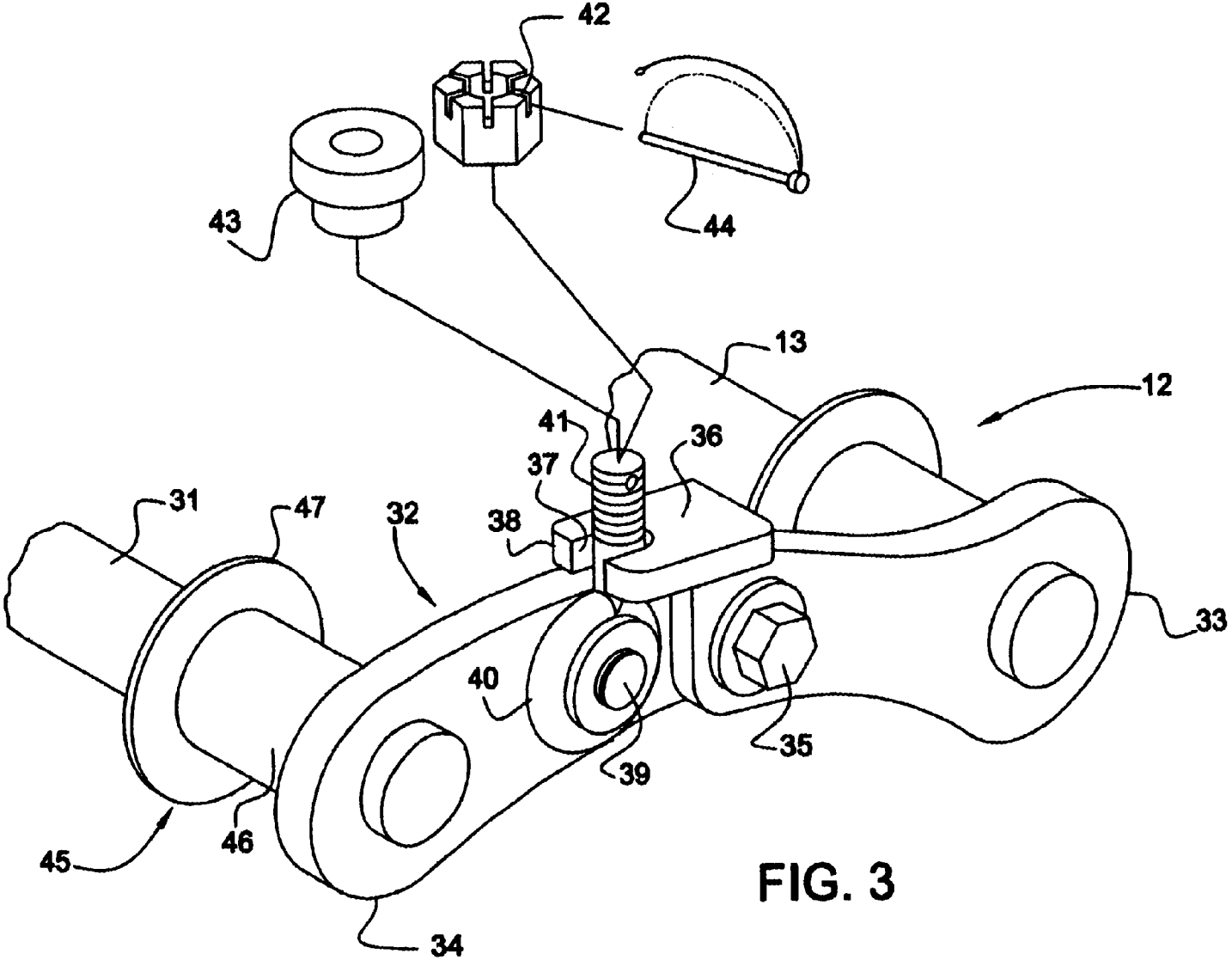
FIG. 3 is an enlarged, perspective view of the coupling assembly shown in FIGS. 1 and 2, illustrating certain components in exploded relation and having portions thereof broken away.

Coupling assembly 12 is best seen in FIG. 3 and includes a connecting pin 13, a connecting pin 31 spaced from and parallel to connecting pin 13 and a pair of identical spacer links 32, 32. Each spacer link includes a first link segment 33 rigidly mounted on connected pin 13 and projecting substantially radially therefrom, a second link segment 34 rigidly connected to an end of connecting pin 31 and projecting substantially radially therefrom and a pin 35 pivotally connecting overlapping, free ends of link segments 33 and 34. Mounted on an upper edge of link segment 33 and extending beyond the free end, thereof is a plate member 36 having a recess 37 disposed in a forwardly disposed edge 38. Mounted on a pin 39 rigidly secured to link segment 34 is a toggle bolt 40 having a shank portion 41 adapted to be received through recess 37 of plate member 36 when each spacer link 32 is in an extended, operative condition as shown in FIGS. 2 and 3. The shank portion of the toggle bolt extends through recess 37 and is threaded to receive either a threaded nut 42 or a knurled knob 43 to releasably secure the shank portion of the toggle bolt within recess 37 and correspondingly the link segments in their extended, operative position as shown in FIGS. 2 and 3. A locking pin 44 may be used with the hex nut 42 which is adapted to be inserted in registrable openings in the shank portion of the toggle bolt and hex nut 42 to prevent the nut from running off of the toggle bolt when the assembly is in use.

The spacer link shown in FIG. 3 is adapted to be positioned on one side of the dipper stick as shown in FIGS. 1 and 2 and the other such spacer link is adapted to be positioned on the other side of the dipper stick. When connecting pins 13 and 31 are displaced toward each other, the link segments of each spacer link will be caused to angularly displace towards each other to retracted, inoperative positions as shown in FIG. 1, and when such connecting pins are displaced apart, the link segments of each spacer will be caused to angularly displace apart to extended, operative positions as shown in FIG. 2. As a set of link segments angularly displace apart to positions as shown in FIG. 3, plate member 36 will engage an upper edge of link segment 34 to position recess 37 for receipt of the shank portion of toggle bolt 39. Link segment 33, recess 37 and toggle bolt 40 are adapted to pivot in the same plane so that when a pair of link segments are angularly displaced as shown in FIG. 3, recess 37 will be properly aligned to receive the shank portion of toggle bolt 40.

With bucket 11 positioned on the ground and assembly 12 disposed in the retracted, inoperable condition as shown in FIG. 1, such bucket may be coupled to the dipper stick by first manipulating the dipper stick to insert the ends of connecting pin 13 in the forwardly disposed recess portions of the mounting brackets on the implement, and then operating the actuating assembly 18 to cause link segments 33 and 34 to angularly displace apart, and correspondingly the end portions of connecting pin 27 to be inserted in the rearwardly disposed recess portions of the mounting brackets. As the dipper stick and the actuating assembly are thus maneuvered to insert connecting pins 13, 31 into oppose recesses 30 and 29, respectively, connecting pin 13 will be caused to engage guide surface 29 and be guided into recesses 30 and connecting pin 31 will be caused to engage guide surface 27 and thus be guided into recess 29. When connecting pins 13 and 31 are thus positioned in mounting brackets 25, 25 and plate number 36 engages the upper surface of link segment 34, the toggle bolt on each link segment 34 is swung upwardly to insert the shank portion thereof within aligned recess 37 and a nut 42 or a knob 43 is threaded onto the threaded shank portion and tightened against plate number 36 to firmly secure the coupling assembly in its extended, operative condition with the implement pivotally connected to the dipper stick.

To uncouple the bucket from the dipper stick, the coupling procedure as described is essentially reversed. Nut 42 or knob 43 is first removed, the toggle bolt is then pivoted out or permitted to fall out of recess 37, actuating assembly 18 is operated to cause the link segments to angularly displace toward each other and thus cause connecting pin 31 to be removed from recesses 29, 29 and then the dipper stick is maneuvered to remove connecting pin 13 from recesses 30, 30. The dipper stick may then be maneuvered and actuating assembly 18 may be operated to couple another implement having a set of mounting brackets similar to mounting brackets 25, 25 to the dipper stick in the manner as described.

To accommodate dipper sticks of different thickness or implement mounting brackets of different sizes, adapter bushings 45 may be provided on the ends of the connecting pins. Such bushings include a cylindrical portion 46 adapted to receive a connecting pin and having different lengths and diameters, and an annularly portion 47 adapted to bear against a sidewall of the dipper stick.

Figure 4A:
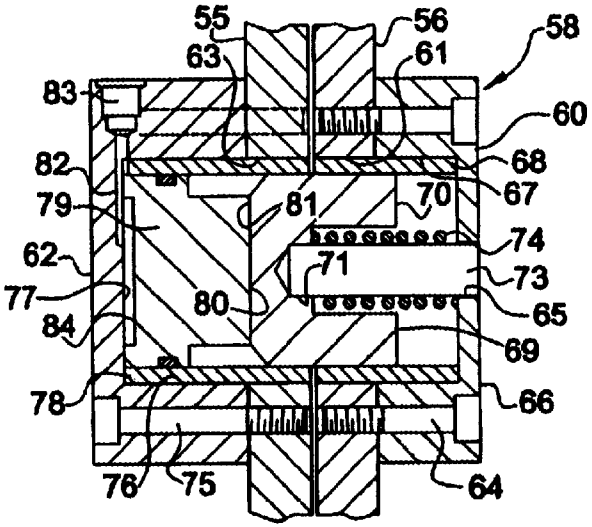
FIG. 4A is an enlarged cross sectional view taken along line 4A—4A in FIG. 4, illustrating a latch mechanism in a latched condition.
Figure 4B:
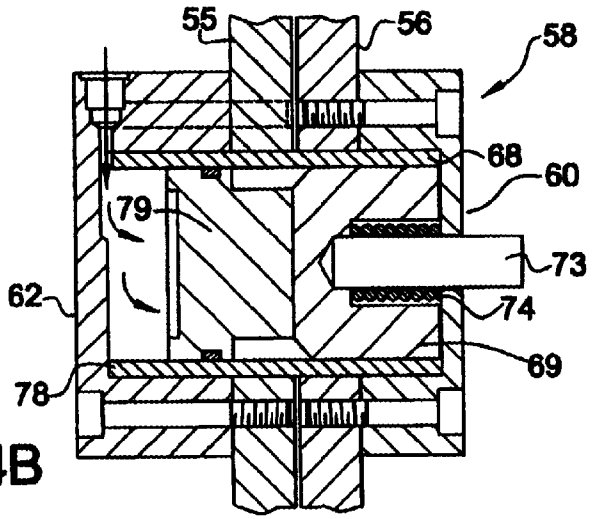
FIG. 4B is a view similar to the view shown in FIG. 4A, illustrating the latch mechanism in an unlatched condition.
Figure 4:
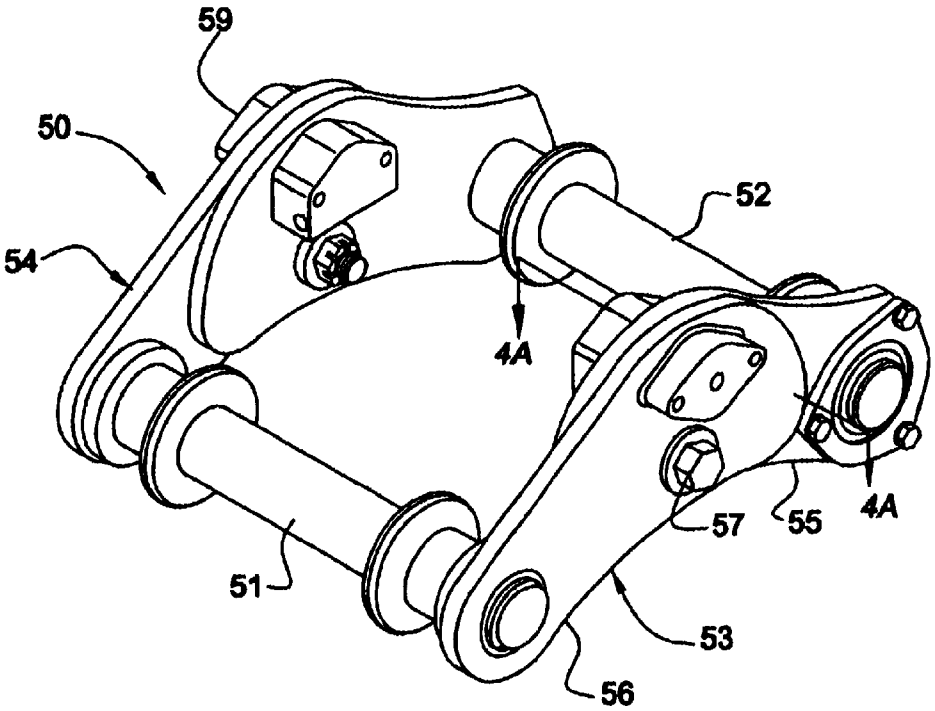
FIG. 4 is a perspective view of another coupling assembly embodying the present invention.

Referring to FIGS. 4, 4A and 4B, there is illustrated a coupling assembly 50 embodying the present invention which may be used in a manner similar to coupling assembly 12 to detachably couple implement 11 to dipper stick 10. Generally, assembly 50 includes a pair of spaced, parallel connecting pins 51 and 52 comparable to connecting pins 31 and 13 of assembly 12, and a pair of transversely spaced, parallel spacer links 53 and 54. The spacer links are adapted to straddle the lower end of the dipper stick and are substantially similar in construction and operation. As best shown in FIG. 4, spacer link 53 includes a link segment 55 rigidly secured to an end portion of connecting pin 52 and disposed substantially radially relative thereto, and a link segment 56 rigidly secured to an end portion of connecting pin 51 and disposed substantially radially relative thereto. The free ends of such segments are disposed in overlapping relation and are pivotally connected together by means of a bolt 57.

The segments of spacer links 53 and 54 are adapted to be maintained in their extended, operative positions as shown in FIG. 4 by means of a pair of latch mechanisms 58 and 59 mounted on the spacer links. Such mechanisms are substantially identical in construction and operation. As best shown in FIGS. 4A and 4B, latch mechanism 58 includes a housing 60 mounted on link segment 56 overlying a circular opening 61 therein, and a housing 62 secured to link segment 55 overlying, a circular opening 63 therein adapted to register with opening 61 in link segments 55 and 56 when such segments are in their extended, operative positions as shown in FIG. 4. Housing 60 is secured to link segment 56 by means of a set of bolts 64 and is provided with a cylindrical opening 65 in an end wall 66 thereof, disposed coaxially with opening 61 and having an enlarged section 67 having a diameter equal to the diameter of opening 61. Disposed within enlarged section 67 and opening 61 is a cylindrical guide sleeve 68 in which there is disposed a latch member 69 which is adapted to displace axially within guide sleeve 68. An outer face 70 of latch member 69 is provided with an axial opening 71 having an enlarged section 72. Mounted in opening 71 and extending into and projectable beyond opening 65 in the housing is a guide pin 73. Latch member 69 is urged away from end wall 60 of housing 58 by means of a coil spring 74 received within enlarged section 72 of the latch member and interposed between an annular end wall of enlarged section 72 and housing end wall 60. As best shown in FIG. 4B, the axial dimension of latch member 69 is the same or slightly less than the axial dimension of guide sleeve 68 so that when the latch member is fully retracted within guide sleeve 68 to compress spring 74, it will be received entirely within guide sleeve 68 to permit link segments 55 and 56 to annularly displace relative to each other about the axis of pivot bolt 57.

Housing 62 is similar in construction to housing 60 and is firmly secured to link segment 55 overlying cylindrical opening 63 by means of a set of bolts 75. The inner face of such housing is provided with a recess having a cylindrical wall 76 having a diameter similar to the diameter of opening 63, and an end wall 77. Disposed within such recess and opening 63 is a cylindrical guide sleeve 78 which is adapted to be axially aligned with guide sleeve 68 when link segment openings 61 and 63 are registered. Disposed within guide sleeve 68 is a piston member 79 having an inner face 80 engageable with an inner face 81 of latch member 69. Housing 62 further is provided with a fluid passageway 82 interconnecting an inlet 83 and an outlet communicating with a chamber defined by the end wall of housing 62, guide sleeve 76 and piston member 79. Inlet 83 is adapted to be connected through a fluid line to a source of fluid under pressure provided with suitable control means for selectively applying fluid under pressure to fluid passageway 82. It will be appreciated that upon applying fluid under pressure to passageway 82, piston member 79 will be caused to displace axially to correspondingly displace latch member 69 against the biasing action of coil spring 74. To accommodate such displacement, the outer face of piston member 79 is provided with a recess 84 communicating with the outlet of passageway 82 to provide a greater bearing surface for fluid injected through passageway 82 and acting upon piston member 79.

Whenever coupling assembly 50 is in its extended, operative condition with the link segments thereof in their extended, operative positions and openings 61 and 62 registered, the biasing action of coil springs 74 will cause the latch members of mechanisms 58 and 59 to displace into the guide sleeves of the aligned housing to latch the link segments in their extended, operative positions. When it is desired to unlatch the link segments, fluid under pressure is applied to passageways 82 to cause the piston members in the mechanisms to displace and correspondingly displace the latch members against the action of the coil springs. Under such circumstances, the latch members will be caused to be retracted fully within their housings, unlatching the pivotally connected link segments and allowing them to pivot relative to each other from extended, operative positions to retracted, inoperative positions to permit a coupled implement to be uncoupled from the dipper stick. The axial dimension of each latch member prevents the displacement of an associated piston member from extending beyond the opening in which such piston member is disposed to prevent the latching of the adjoining link segments when the latch member thereof is fully retracted.

Figure 5A:
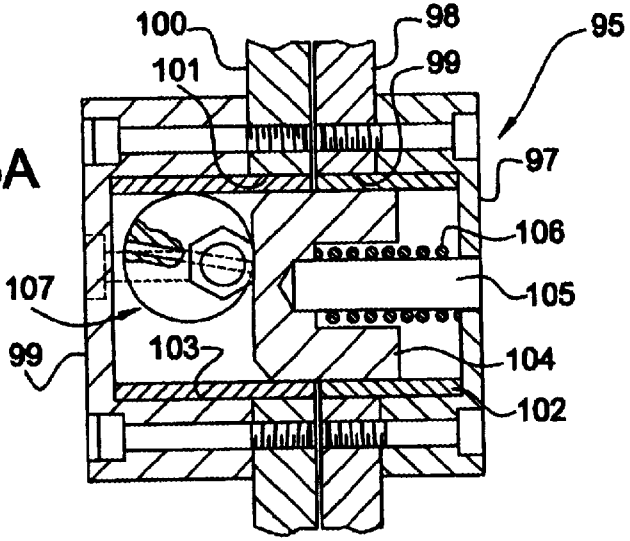
FIG. 5A is a cross sectional view taken along line 5A—5A in FIG. 5, illustrating the latch mechanism in a latch condition.
Figure 5B:
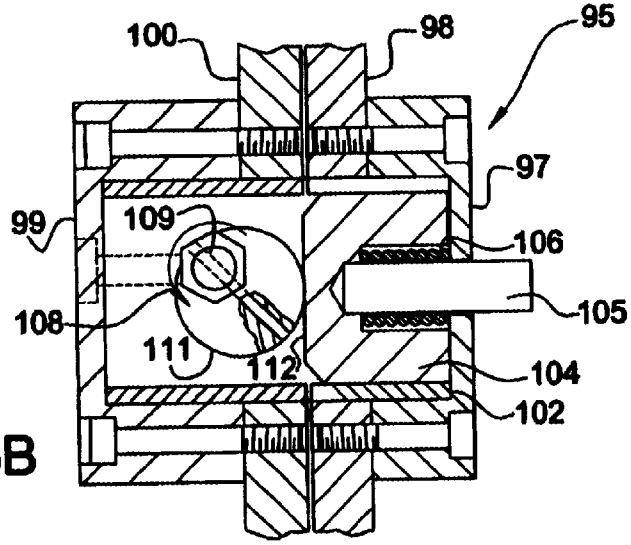
FIG. 5B is a view similar to the view shown in FIG. 5A, illustrating the latch mechanism in an unlatched condition.
Figure 5:
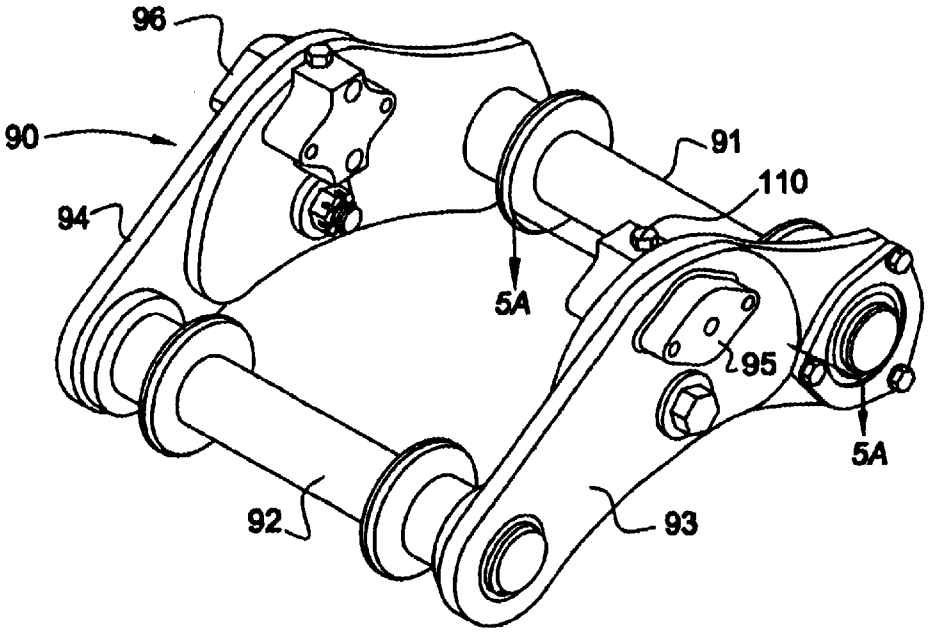
FIG. 5 is a perspective view similar to the view shown in FIG. 4, illustrating an embodiment provided with an alternate latch mechanism.

FIGS. 5, 5A and 5B illustrate a further alternate coupling assembly 90 embodying the present invention. The assembly includes a set of spaced, parallel connecting pins 91 and 92 comparable in construction and operation to connecting pins 13 and 31, a pair of spacer links 93 and 94 comparable to spacer links 53 and 54 and a pair of latch mechanisms 95 and 96 comparable to latch mechanisms 58 and 59 with the exception of the means provided for displacing the latch member. Latch members 95 and 96 are essentially the same in construction and operation. Referring to FIGS. 5A and 5B, latch mechanism 95 includes a housing 97 rigidly secured to a link segment 98 overlying a circular opening 99 in such segment and a housing 99 rigidly mounted on link segment 100 overlying a circular opening 101 therein adapted to register with opening 99 when the assembly is in its extended, operative condition as shown in FIG. 5. Housings 97 and 99 are provided with registrable, cylindrical guide sleeves 102 and 103 in which there is provided an axially displaceable latch member 104. As in the previously described embodiment, latch member 104 is provided with an axially disposed guide pin 105 disposed within and extendable beyond an opening in an end wall of housing 95 and a coil spring 106 operable to displace the latch member into a registered guide sleeve 103 as shown in FIG. 5A, and compressable to allow the latch member to be displace entirely within guide sleeve 102 and thus permit the link segments to angularly displace relative to each other. The latch member is caused to displace axially to a retracted position within guide sleeve 102 against the biasing action of spring 106 by means of a cam device 107 provided on housing 99 within guide sleeve 103. The device consists of a bolt 108 having a shank portion 109 extending through an opening in an upper wall of housing 99 and aligned openings in guide sleeve 103, and threaded into an opening in a bottom wall of the housing, and a head portion 110 disposed on the exterior of the housing. Rigidly connected to the shank portion of bolt 108, within guide sleeve 103, is a cam element 111 which is adapted to be engaged by an end wall surface 112 of latch member 104. Cam element 103 has a circular configuration and is econtrically mounted relative to the axis of shank portion 109 so that upon rotating bolt 108 about its axis, the latch member biased into engagement with the cam element will be caused to displace axially into a latching position as shown in FIG. 5A and an unlatched position as shown in FIG. 5B. Typically, the cam device will be rotated to latch and unlatch the link segments merely by applying a tool to the head portion of the device and rotating it. In addition to providing a manually operable camming device as shown in FIGS. 5, 5A and 5B, such device may be provided with a small motor mounted on housing 99 which can be operated from a remote site such as the operators station on the machine. As best illustrated in FIG. 5B, the axial dimension of the latch member is made the same as the axial dimension of guide sleeve 102 so that when the latch member is fully retracted against the biasing action of the spring, cam element 111 will be precluded from entering guide sleeve 102 and thus provide, an obstruction preventing the link segments to be angularly displaced relative to each other.

In each of the embodiments as described, various additional features may be included to facilitate and enhance the operations of the coupling assemblies. As previously mentioned, spacer bushings may be provided on the ends of the connecting pins to center the coupling assemblies, adapt them to different dipper stick sizes and accommodate different pin receiving openings in the mounting brackets of implements to be coupled. The connecting pins mounted on the dipper stick may be rigidly connected to one set of link segments as described and pivotally connected to the dipper stick or pivotally connected to such link segments and rigidly connected to the dipper stick. Similarly, the connecting pins connected to the actuating links may be rigidly connected to a set of link segments and pivotally connected to the actuating links as described or pivotally connected to such link segments and rigidly connected to the actuating links. To prevent the sets of links segments from freely, angularly displacing relative to each other, the pivot bolts therefore may be provided with Bellville washers to retard any free angular displacement. In lieu of a manually operable arrangement as shown in FIGS. 1 through 3, remotely operable latch and unlatching devices may be provided as shown in FIGS. 4 through 5A. Such remotely operated arrangements may be either electrically, hydraulically or pneumatically actuated.

It further will be appreciated that the present invention provides an arrangement whereby a conventional excavating machine and a plurality of conventional implements including buckets, grapples, racks and the like may be easily and inexpensively modified to permit such machine to easily couple and uncouple a variety of implements. Such arrangement involves not only simple modifications of the machine dipper stick and the implements to be coupled to the machine but the addition of a few, simple components.

From the foregoing detailed description, it will be evident that there are a number of changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the appended claims.

I claim:

1. An assembly mountable on a machine comprising:

an implement provided with at least one pair of pin receiving recesses;

a dipper stick operatively connectable to said machine for selected movements, having a first connecting pin rotatably mounted in an end thereof and receivable in one of said implement recesses;

at least one support link pivotally connected to said dipper stick;

at least one actuating link pivotally connected to said support link, having a second connecting pin rotatably mounted therein and receivable in the other of said implement recesses;

at least one spacer link including a pair of segments pivotally connected together and angularly displaceable relative to each other between retracted, inoperative positions and extended, operative positions, one of said segments being secured to one of said connecting pins and the other of said segments being secured to the other of said connecting pins and having means mountable thereon and cooperable with said one segment when said segments are disposed in said extended, operative positions for releasably securing said segments in said extended, operative positions; and a fluid actuated assembly operatively interconnecting said dipper stick and one of said support link and said actuating link wherein upon operation of said actuating assembly, said link segments will be caused to be displaced between said retracted, inoperative and extended, operative positions, and said connecting pins correspondingly will be caused to be displace relative to each other to be inserted into and withdrawn from said implement recesses for correspondingly coupling and uncoupling said implement relative to said dipper stick upon manipulation of said dipper stick.

2. An assembly according to claim 1 including a pair of said links, each disposed on a side of said dipper stick.

3. An assembly according to claim 1 wherein a portion of said dipper stick, said support link, said actuating link and said spacer link when said link segments are in their extended, operative positions and secured together form a four bar linkage.

4. An assembly according to claim 1 wherein the pivotal connection between said support and actuating links and between said fluid actuating assembly and one of said support and actuating links are coaxial.

5. An assembly according to claim 1 wherein said releasably securing means comprises a latch mounted on said one link segment and cooperable with said other link segment when said link segments are in their extended, operative positions, for preventing said link segments from displacing to their retracted, inoperative positions.

6. An assembly according to claim 5 wherein said one link segment includes a surface having a recess and said latch comprises a toggle bolt pivotally connected to said other link segment, having a threaded shank portion angularly displaceable into and out of said recess when said link segments are disposed in their extended, operative positions, and a threaded member threadable on said toggle bolt and against said surface when said shank portion is received within said recess.

7. An assembly according to claim 6 wherein said surface lies in a plane which intersects a plane of movement of said one link segment when displaced between said retracted, inoperable and extended, operable positions thereof.

8. An assembly according to claim 6 wherein said recess is disposed in the plane of angular displacement of said one link segment, and said toggle bolt is angularly displaceable in said plane.

9. An assembly according to claim 1 wherein said one link segment is provided with a recess, said other link segment is provided with a displaceable locking pin registrable with and receivable in said recess of said one link segment when said link segments are disposed in said extended, operative positions, securing said link segments in said extended, operative positions, means mounted on said other link segment for biasingly urging said locking pin in said recess to secure to link segments in said extended, operative positions when said pin is registered with said recess, and means disposed in said recess selectively actuated for displacing said locking pin out of said recess to release said link segments and thus allow them to be displaced to said retracted, inoperative positions.

10. An assembly according to claim 9 wherein said biasing means comprises a coil spring disposed between said other link segment and said locking pin.

11. An assembly according to claim 9 wherein said locking pin displacing means comprises a fluid actuated piston.

12. An assembly according to claim 9 wherein said displacing means comprises a camming device.

13. An assembly according to claim 12 wherein said camming device is remotely operated.

14. An assembly mountable on a dipper stick operatively connected to a machine, having its fluid actuated assembly, and connectable to an implement having at least one pair of opposed, connecting pin receiving recesses, comprising:

at least one spacer link including a pair of segments pivotally connected together and angularly displaceable relative to each between retracted, inoperable and extended, operable positions, one of such segments having a pin portion connectable to said dipper stick for pivotal movement about its axis and receivable in one of said implement recesses and the other of said link segments having a pin portion operatively connectable to said fluid actuated assembly for pivotal movement about its axis and receivable within the other of said implement recesses, and means mounted thereon and cooperable with said one link segment when said segments are disposed in said extended operative positions for releasably securing said segments in said extended, operative positions.

15. An assembly according to claim 14 including a pair of said spacer links, each disposed on a side of said dipper stick.

16. An assembly according to claim 14 wherein when said link segments are in their extended, operative positions and connected to said dipper stick and said actuating assembly, said spacer link, a portion of said dipper stick, a portion of said actuating assembly and a support link interconnecting said dipper stick and said portion of said actuating assembly form a four bar linkage.

17. An assembly according to claim 14 wherein said releasably securing means comprises a latch mounted on said one link segment and cooperable with said other link segments when said link segments are in their extended, operative positions for preventing said link segments from displacing to their retracted, inoperative positions.

18. An assembly according to claim 17 wherein said one link segment includes a surface having a recess and said latch comprises a toggle bolt pivotally connected to said other link segment, having a threaded shank portion angularly displaceable into and out of said recess when said link segments are disposed in their extended, operative positions, and a threaded member threadable on said toggle bolt and against said surface when said shank portion is received within said recess.

19. An assembly according to claim 18 wherein said surface lies in a plane which intersects a plane of movement of said one link segment when displaced between said retracted, inoperable and extended, operable positions thereof.

20. An assembly according to claim 18 wherein said slot is disposed in the plane of angular displacement of said one link segment, and said toggle bolt is angularly displaceable in said plane.

21. An assembly according to claim 14 when said one link segment is provided with a recess, said other link segments is provided with a displaceable locking pin registrable with and receivable in said recess of said one link segment when said link segments are disposed in their extended, operative positions, locking said link segments in their extended, operative positions, means mounted on said other link segment for biasingly urging said locking pin into said recess to lock said link segments in their extended operative positions when said pin is registered with said recess, and means disposed in said recess selectively actuated for displacing said locking pin out of said recess to release said link segments and thus allow them to be displaced to said retracted, inoperative positions.

22. An assembly according to claim 21 wherein said biasing means comprises a coil spring disposed between said other link segment and said locking pin.

23. An assembly according to claim 21 wherein said pin displacing means comprises a fluid actuated piston.

24. An assembly according to claim 21 wherein said displacing means comprises a camming device.

* * * * *